US007138922B2

(12) United States Patent
Strumolo et al.

(10) Patent No.: US 7,138,922 B2
(45) Date of Patent: Nov. 21, 2006

(54) DROWSY DRIVER MONITORING AND PREVENTION SYSTEM

(75) Inventors: Gary Steven Strumolo, Beverly Hills, MI (US); Sean Timothy Ryan, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 158 days.

(21) Appl. No.: 10/249,133

(22) Filed: Mar. 18, 2003

(65) Prior Publication Data

US 2004/0183685 A1 Sep. 23, 2004

(51) Int. Cl.
*G08B 23/00* (2006.01)

(52) U.S. Cl. ..... 340/575; 340/576; 340/998; 340/539.18; 600/300; 600/301

(58) Field of Classification Search ..... 340/576, 340/457, 575, 309.15, 436, 438, 995, 539.18, 340/998; 600/300, 301
See application file for complete search history.

(56) References Cited

U.S. PATENT DOCUMENTS 5,572,204 A * 11/1996 Timm et al. ..... 340/988
5,573,006 A * 11/1996 Shimotani et al. ..... 600/558
5,689,241 A * 11/1997 Clarke et al. ..... 340/575
5,786,765 A * 7/1998 Kumakura et al. ..... 340/576
5,813,993 A * 9/1998 Kaplan et al. ..... 600/544
5,917,415 A 6/1999 Atlas
5,942,979 A 8/1999 Luppino
6,049,747 A * 4/2000 Nakajima et al. ..... 701/45
6,091,334 A * 7/2000 Galiana et al. ..... 340/576
6,097,295 A * 8/2000 Griesinger et al. ..... 340/576
6,150,932 A * 11/2000 Kenue ..... 340/435
6,239,707 B1 * 5/2001 Park ..... 340/576
6,275,146 B1 8/2001 Kithil et al.
6,340,928 B1 * 1/2002 McCurdy ..... 340/436
6,353,396 B1 3/2002 Atlas
6,393,348 B1 * 5/2002 Ziegler et al. ..... 701/45
6,614,469 B1 * 9/2003 Kato et al. ..... 348/148
2002/0126022 A1 * 9/2002 Ellis ..... 340/901
2002/0128751 A1 9/2002 Engstrom et al.
2002/0140289 A1 10/2002 McConnell et al.

* cited by examiner

*Primary Examiner*—Tai Nguyen
(74) *Attorney, Agent, or Firm*—Frank A. MacKenzie

(57) ABSTRACT

A drowsy driver detection system (10) for an automobile (12) is coupled to a service center (16) through a communication system (14). A drowsy driver sensor (30) coupled to a controller (32) and a communication device (60) is used to determine the drowsiness of a vehicle operator by monitoring actions of the vehicle operator. When it is determined by the controller (32) that a vehicle operator is drowsy, controller (32) initiates communication device (60) to communicate a communication signal to service center (16). A response signal is generated by the service center (16) to the vehicle operator through communication device (60) to alert the driver and direct the driver to a rest area.

20 Claims, 1 Drawing Sheet

DROWSY DRIVER MONITORING AND PREVENTION SYSTEM

BACKGROUND OF INVENTION

The present invention relates generally to control systems for automotive vehicles, and more particularly, to a control system that detects the drowsiness of the driver and communicates this information to the driver.

It has been estimated that approximately 150,000 automobile accidents per year are caused by drivers that fall asleep at the wheel. Such drivers not only put themselves at risk but put others at risk as well.

Conventional approaches to drowsy drivers include detecting bodily signs from the driver to determine if the driver is drowsy. When a drowsy driver is detected, alarms may be used to alert the vehicle operator. Such systems may often be ignored especially when the vehicle driver falls into a deeper sleep.

It would therefore be desirable to provide a system that drivers cannot easily ignore and thus goes beyond the suggested warning lights and buzzers.

SUMMARY OF INVENTION

The present invention provides a system that connects a service operator from a wireless connected service center to the vehicle to alert the driver and provide the driver with various types of information.

In one aspect of the invention a drowsy driver detection system includes a drowsy driver sensor generating a drowsy driver signal, a communication system and, a controller coupled to the drowsy driver sensor and the communication system. The controller controls the communication system in response to a drowsy driver signal from the drowsy driver sensor.

In a further aspect of the invention a method for operating a vehicle system includes monitoring a vehicle operator, generating a drowsy driver signal in response to vehicle operator actions, contacting a service center with a communication system in response to the drowsy driver signal, and directing a communication signal from a service center to a vehicle.

One advantage of the invention is that a system operator may direct a drowsy driver to the nearest restaurant, freeway exit, or other area for the vehicle operator to rest. A further advantage of the invention is that after allowing a vehicle operator to rest, the system operator may provide a wake-up call so that the vehicle operator can rest without worry.

Other advantages and features of the present invention will become apparent when viewed in light of the detailed description of the preferred embodiment when taken in conjunction with the attached drawings and appended claims.

DETAILED DESCRIPTION

Figure 1:
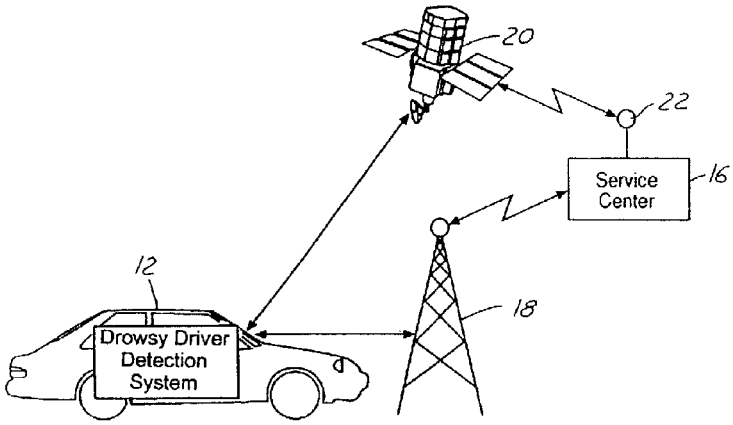
FIG. 1 is a high level systematic view of the system according to the present invention.

In the following figures the same reference numerals will be used to illustrate the same components.

The present invention is described with respect to several different ways in which to monitor if a driver is drowsy. However, those skilled in the art will recognize that various other ways in which to detect a drowsy driver or combinations thereof may be formed. Further, different types of communication devices and therefore communication methods may be used by the present invention including combinations of different devices.

Referring now to FIG. 1, a drowsy driver detection system 10 is illustrated in an automotive vehicle 12. The drowsy driver detection system 10 communicates through a communication system 14 to a service center 16. Communication system 14 is preferably two-way so that service center 16 also communicates with drowsy driver detection system 10.

Automotive vehicle 12 may be one of various types of automotive vehicles including cars, sport utility vehicles, vans, or trucks.

Communication system 14 may include various types of communication systems including a cellular communication system or a satellite communication system. A cellular communication system may include a cell tower 18 that receives communication signals from drowsy driver detection system and transmits them to a service center 16. A satellite communication system may include a satellite 20 that communicates communication signals from drowsy driver detection system 10 to service center 16. The service center 16 generates a response signal that is communicated through the communication system 14 back to drowsy driver detection system 10. As will be further described below, communication system preferably provides two-way communication so that a service operator at a service center 16 may communicate to the drowsy driver detection system. It should be noted that service center 16 may include an antenna to wirelessly communicate with either satellite 20 or cell tower 18. However, the cell tower and service center 16 may also be coupled through the public service telephone network. Thus, the communication system is at least partially wireless.

Figure 2:
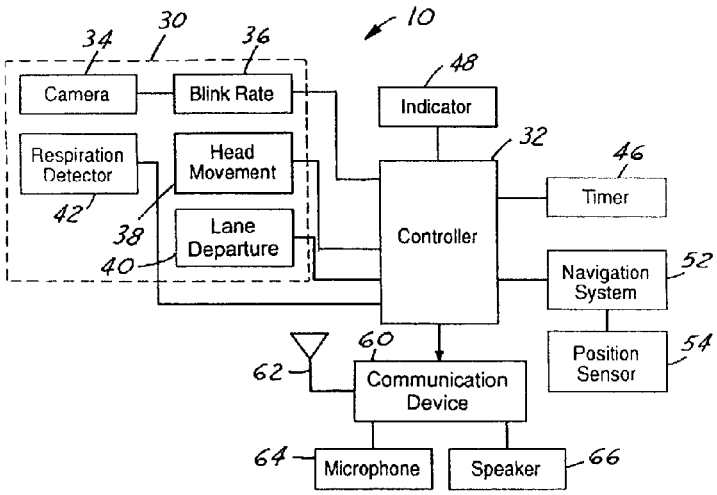
FIG. 2 is a block diagrammatic view of the drowsy driver detection system in a vehicle.

Referring now to FIG. 2, drowsy driver detection system 10 is illustrated in further detail. Drowsy driver detection system 10 includes a drowsy driver sensor 30 that is coupled to a controller 32. Controller 32 is preferably microprocessor-based. Drowsy driver sensor 30 may have different types of sensors or combinations of sensors that are used to generate a drowsy driver signal. For example, a camera 34 may be directed at the vehicle operator to monitor the vehicle operator's actions by generating an image signal. The image signal may be a digital signal through the use of a CCD camera or the like. Various actions may be monitored by a camera or multiple cameras including blink rate 36 or head movement 38. Camera 34 may also be positioned at the road so that lane departure 40 may be determined. This is also an action of the vehicle operator. In addition, a respiration detector 42 may also be coupled to controller 32. Preferably, the controller 32 is used to monitor the camera 34 and internally calculates a blink rate signal in response to blink rate 36, a head movement signal in response to head movement 38, or a lane departure signal in response to a lane departure 40. It should be noted the camera processing or the controller may be used in practice to determine the various signals such as blink rate. Also, a respiration signal may also be provided directly by respiration detector 42 or may be calculated by controller 32. Controller 32 ultimately determines by scoring directly or by formulating a response to multiple sensors and comparing the value to a threshold over which a drowsy driver is determined.

Controller 32 may, for example, be coupled to a timer 46 used to time such things as blink rate or head movement within a predetermined amount of time. Likewise, a number of lane departures over a predetermined amount of time or a change in respiration over a predetermined amount of time may be determined by controller 32.

Controller 32 may be coupled to an indicator 48. Indicator 48 may, for example, be an audible indicator or a visual indicator that alerts the vehicle operator to the controller 32 sensing the drowsiness of a driver.

A navigation system 52 may also be coupled to controller 32. Navigation system 52 is coupled to a position sensor 54 such as a global position sensor to provide position information to navigation system 52 which may be passed along to controller 32.

Controller 32 is also coupled to a communication device 60. Communication device 60 is coupled to an antenna 62 for transmitting and receiving information therefrom. Communication device 60 may also be coupled to a microphone 64 and a speaker 66 so that the communication device 60 may receive information from the vehicle driver and generate audible signals from signals received through the antenna 62.

Figure 3:
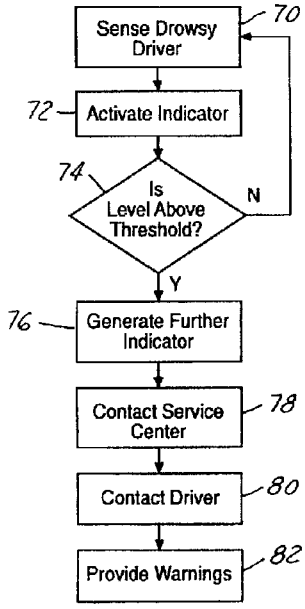
FIG. 3 is a flow chart of the operation of the drowsy driver detection system according to the present invention.

Referring now to FIG. 3, the operation of the drowsy driver detection system 10 in conjunction with the communication system 14 and service center 16 is described in further detail. In step 70 a drowsy driver is sensed by monitoring the action of the vehicle operator. In step 72, the controller receives or generates the various signals from the drowsy driver sensor and if some drowsiness is sensed, an indicator may be activated in step 72. This may correspond to a low level of drowsiness. In step 74, if the level of drowsiness does not exceed a predetermined threshold, step 70 is repeated. In step 74, if the level of drowsiness is above a threshold a further indicator may be generated in step 76. In step 78, the service center receives a communication signal generated by the communication device 60 in response to the controller 72 determining the drowsiness of a driver. In step 80, a driver is contacted by an operator through the communication system from the service center to the communication device 60. The signal generated by the service center is a response signal. The service center may generate a verbal response warning as shown in step 82. The warning provided to the operator may be simply a signal or indicator to get the attention of the vehicle operator. The signal may be verbal through the communication device. The operator of the service center and the vehicle operator may thus have a conversation. The service center operator may, for example, provide the vehicle operator with directions to the nearest rest area, exit, gas station, or other places for the vehicle operator to rest. In addition, the two-way communication system may be used to wake the driver after a predetermined period of rest. The service center operator may receive a position signal transmitted from the transmission sensor 54 and ultimately through communication device 60 to the service center 16.

While particular embodiments of the invention have been shown and described, numerous variations and alternate embodiments will occur to those skilled in the art. Accordingly, it is intended that the invention be limited only in terms of the appended claims.

The invention claimed is:

1. A drowsy driver detection system comprising:

a drowsy driver sensor generating a drowsy driver signal;

a communication device; and a controller coupled to said drowsy driver sensor and said communication device, said controller controlling said communication device in response to said drowsy driver signal, wherein said communication device receives a response signal from a communication system in response to transmission of said drowsy driver signal, wherein said drowsy driver sensor comprises a camera generating a first image signal and a second image signal, said controller generating at least two of a blink rate signal, a head movement signal and a lane departure signal in response to the first image signal and the second image signal, said controller controlling said communication device in response to at least two of a blink rate signal, a head movement signal and a lane departure signal, said communication device receiving a response signal from said communication system in response to transmission of at least two of a blink rate signal, a head movement signal and a lane departure signal.

2. A drowsy driver detection system as recited in claim 1 wherein said communication device comprises a cellular phone system.

3. A drowsy driver detection system as recited in claim 1 wherein said communication device comprises a satellite communication system.

4. A drowsy driver detection system as recited in claim 1 further comprising an indicator coupled to said controller, said controller coupled to said indicator.

5. A drowsy driver detection system as recited in claim 4 wherein said indicator comprises an audible indicator.

6. A drowsy driver detection system as recited in claim 4 wherein said indicator comprises a visual indicator.

7. A drowsy driver detection system as recited in claim 1 further comprising a positioning system generating a vehicle position signal, said communication device communicating said position signal with the drowsy driver signal.

8. A drowsy driver detection system as recited in claim 1, wherein said drowsy driver sensor further comprises a respiration detector generating a respiration signal.

9. A system comprising:

a drowsy driver sensor generating a drowsy driver signal;

a communication device;

a controller coupled to said drowsy driver sensor and said communication device, said controller controlling said communication device to generate a communication signal in response to said drowsy driver signal; and a service center two-way coupled to said communication device, said service center generating a response signal in response to said communication signal, wherein said drowsy driver sensor comprises a camera generating a first image signal and a second image signal, said controller generating at least two of a blink rate signal, a head movement signal and a lane departure signal in response to the first image signal and the second image signal, said controller controlling said communication device in response to at least two of a blink rate signal, a head movement signal and a lane departure signal, said communication device receiving a response signal from said service center in response to transmission of at least two of a blink rate signal, a head movement signal and a lane departure signal.

10. A system as recited in claim 9 further comprising an indicator coupled to said controller, said controller coupled to said indicator.

11. A drowsy driver detection system as recited in claim 10 wherein said indicator comprises an audible indicator.

12. A drowsy driver detection system as recited in claim 10 wherein said indicator comprises a visual indicator.

13. A system as recited in claim 9 further comprising a positioning system generating a vehicle position signal, said communication device communicating said position signal with the communication signal.

14. A drowsy driver detection system as recited in claim 9 wherein said communication device comprises a cellular phone system.

15. A drowsy driver detection system as recited in claim 9 wherein said communication device comprises a satellite communication system.

16. A drowsy driver detection system as recited in claim 9, wherein said drowsy driver sensor further comprises a respiration detector generating a respiration signal.

17. A method of operating a communication system comprising:

monitoring a vehicle operator actions;

generating from a drowsy driver sensor a drowsy driver signal in response to vehicle operator actions;

contacting a service center with a communication device in response to the drowsy driver signal; and directing a response signal from a service center to a vehicle, wherein said drowsy driver sensor comprises a camera generating a first image signal and a second image signal, said controller generating at least two of a blink rate signal, a head movement signal and a lane departure signal in response to the first image signal and the second image signal, said controller controlling said communication device in response to at least two of a blink rate signal, a head movement signal and a lane departure signal, said communication device receiving a response signal from the service center in response to transmission of at least two of a blink rate signal, a head movement signal and a lane departure signal.

18. A method as recited in claim 17 further comprising generating a voice signal within the vehicle in response to the response signal.

19. A method as recited in claim 17 further comprising transmitting a position signal.

20. A drowsy driver detection system as recited in claim 17 further comprising generating a respiration signal from a respiration detector.

* * * * *